US011383114B2

(12) United States Patent
Sato et al.

(10) Patent No.: US 11,383,114 B2
(45) Date of Patent: Jul. 12, 2022

(54) SPRINKLER HEAD

(71) Applicant: SENJU SPRINKLER CO., LTD., Tokyo (JP)

(72) Inventors: Koki Sato, Tokyo (JP); Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 0 days.

(21) Appl. No.: 16/757,238

(22) PCT Filed: Nov. 28, 2017

(86) PCT No.: PCT/JP2017/042598

§ 371 (c)(1),
(2) Date: Apr. 17, 2020

(87) PCT Pub. No.: WO2019/106713

PCT Pub. Date: Jun. 6, 2019

(65) Prior Publication Data

US 2020/0282246 A1 Sep. 10, 2020

(51) Int. Cl.

| | |
|---|---|
| ***A62C 31/02*** | (2006.01) |
| ***B05B 1/26*** | (2006.01) |
| *A62C 37/11* | (2006.01) |

(52) U.S. Cl.
CPC ..... *A62C 31/02* (2013.01); *B05B 1/265* (2013.01); *A62C 37/11* (2013.01)

(58) Field of Classification Search
CPC ..... A62C 31/02; A62C 37/11; B05B 1/265
USPC ..... 169/37, 41
See application file for complete search history.

(56) References Cited

U.S. PATENT DOCUMENTS

| | | | |
|---|---|---|---|
| 6,516,893 | B2 | 2/2003 | Pahila |
| 7,201,234 | B2 | 4/2007 | Rogers et al. |
| 8,905,151 | B2 | 12/2014 | Silva, Jr. et al. |
| 2006/0113092 | A1 | 6/2006 | Rogers et al. |

(Continued)

FOREIGN PATENT DOCUMENTS

| | | | |
|---|---|---|---|
| CN | 104602766 | A | 5/2015 |
| CN | 105263587 | A | 1/2016 |

(Continued)

OTHER PUBLICATIONS

International Search Report for PCT Patent App. No. PCT/JP2017/042598 (dated Feb. 27, 2018).

(Continued)

*Primary Examiner* — Christopher S Kim
(74) *Attorney, Agent, or Firm* — Cermak Nakajima & McGowan LLP; Tomoko Nakajima

(57) ABSTRACT

A sprinkler head includes a main body having a nozzle connected to a water supply pipe, the nozzle is provided inside of the main body, a pair of arms extending from the main body in a water discharge direction of the nozzle, where a tip of each of the arms is connected to a boss that has a columnar shape, that is disposed on a central axis A of the nozzle, and that has a female screw thereinside, an impress screw screwed into the female screw and having a tip protruding toward the nozzle, and a deflector having a disc shape and mounted at a front end of the boss. The deflector has a plurality of slits having an equal length cut around a peripheral edge of the deflector at equal intervals, from an outer periphery of the deflector toward the central axis of the nozzle.

19 Claims, 8 Drawing Sheets

(56) References Cited

U.S. PATENT DOCUMENTS

| | | | |
|---|---|---|---|
| 2007/0246232 | A1 | 10/2007 | Pahila |
| 2010/0132962 | A1 | 6/2010 | Silva, Jr. et al. |
| 2010/0236795 | A1 | 9/2010 | Feenstra |
| 2015/0246253 | A1 | 9/2015 | Miller et al. |

FOREIGN PATENT DOCUMENTS

| | | | |
|---|---|---|---|
| JP | 2001-046544 | A | 2/2001 |
| JP | 2016-067509 | A | 5/2016 |
| WO | WO2013/159063 | A2 | 10/2013 |

OTHER PUBLICATIONS

Office Action from Chinese Patent App. No. 201780097187.3 (dated Mar. 16, 2021).

SPRINKLER HEAD

This application is a national phase entry under 35 U.S.C. § 371 of PCT Patent Application No. PCT/JP2017/042598, filed on Nov. 28, 2017, which is incorporated by reference.

TECHNICAL FIELD

The present invention relates to a fire extinguisher sprinkler head and, in particular, to a residential sprinkler head.

BACKGROUND ART

Sprinkler system is installed in a building. The Sprinkler system detects the heat of the fire and automatically operates to spray water to extinguish the fire. The sprinkler head has a nozzle thereinside, and the nozzle is connected to a pipe leading to a water supply source. The nozzle is in a closed state at normal times. If a fire occurs and the sprinkler head operates due to heat, the nozzle is opened so that the water filled in the pipe is discharged from the nozzle. The sprinkler head is provided with a deflector on the extension of the outlet of the nozzle. The deflector scatters water in all directions. The water striking the deflector is sprayed onto a predetermined area to control and extinguish the fire.

Sprinkler system is installed in commercial facilities, public facilities, residential houses, and the like, and the standard for the installation and construction of Sprinkler system is defined. In the United States, the National Fire Protection Association standards provides NFPA 13, which is the standard for the design and installation of Sprinkler system for building applications. Residential Sprinkler system standards are NFPA 13D and 13R. In addition, Underwriters Laboratories (UL LLC) develops UL 1626, which is the standard for residential sprinkler heads.

Existing residential sprinkler heads include U.S. Pat. Nos. 6,516,893 and 7,201,234. These sprinkler heads obtain a desired water spray pattern with the structure of the deflector. However, the shape of the deflector is complicated. One of the reasons is that the main body used in these residential sprinkler heads is commonly used with sprinkler heads of other specifications and, thus, changes in the structure of the main body are limited.

The water spray pattern is significantly influenced by the shape of the deflector. Furthermore, the water spray pattern is influenced to no small extent by a part of the main body which water discharged from the nozzle strikes.

CITATION LIST

Patent Literature

PTL 1: U.S. Pat. No. 6,516,893
PTL 2: U.S. Pat. No. 7,201,234

SUMMARY OF INVENTION

Technical Problem

Accordingly, it is a first object of the present invention to provide a sprinkler head capable of obtaining a desired water spray pattern with a simplified deflector shape.

A second object of the present invention is to provide a sprinkler head capable of passing a water spraying test and a fire extinguishing test defined by UL 1626 with a minimum flow rate.

Solution to Problem

In order to achieve the above objects, the present invention provides a sprinkler head having the following structure. The sprinkler head includes a main body having a nozzle connected to a water supply pipe, the nozzle is provided inside of the main body, a pair of arms extending from the main body in a water discharge direction of the nozzle, where a tip of each of the arms is connected to a boss that has a columnar shape, that is disposed on a central axis of the nozzle, and that has a female screw thereinside, an impress screw screwed into the female screw and having a tip protruding toward the nozzle, and a deflector having a disc shape and mounted at a front end of the boss. The deflector has a plurality of slits having an equal length cut around a peripheral edge of the deflector at equal intervals, from an outer periphery of the deflector toward the central axis of the nozzle, and a length of a first slit provided at a position closest to a line that perpendicularly intersects with a plane passing through the pair of arms and that passes through the central axis of the nozzle is greater than the length of the other slits.

Furthermore, the sprinkler head has the following structure. The sprinkler head includes a main body having a nozzle connected to a water supply pipe, the nozzle is provided inside of the main body, a pair of arms extending from the main body in a water discharge direction of the nozzle, where a tip of each of the arms is connected to a boss that has a columnar shape, that is disposed on a central axis of the nozzle, and that has a female screw thereinside, an impress screw screwed into the female screw and having a tip protruding toward the nozzle, and a deflector that has a disc shape, that is mounted at a front end of the boss, and that has a plurality of slits cut around a peripheral edge of the deflector. An outer peripheral end of the boss adjacent to the nozzle has a shape of a rounded surface, and an extension line along a shape of the tip of the impress screw is in close vicinity of or in contact with the rounded surface.

The above-described sprinkler head is a residential sprinkler head, and the value of the K factor derived from the flow rate and the water discharge pressure of the nozzle is 3 to 5.8. A desired water spray pattern can be obtained with the shapes of the deflector, the boss having the deflector mounted thereon, and the impress screw provided in the boss. More specifically, by adopting a structure in which turbulence does not easily occur at the tip of the impress screw that the water discharged from the nozzle strikes first and the boundary between the impress screw and the boss, the shape of a slit of the deflector is simplified. As a result, the control of the water spray pattern is facilitated.

The tip of the impress screw protrudes toward the nozzle, and the shape of the tip is sharp, which provide the effect of reducing the resistance of the flow of water and uniformly distributing the water that strikes the tip in all directions. The impress screw has a slope surface from the tip thereof toward the boss, and the water flows along the slope surface. The extension line extending along the slope surface is in close vicinity of or in contact with the rounded surface of the outer peripheral end of the boss and, thus, the water flows smoothly along the rounded surface of the outer peripheral end of the boss from the slope surface. Thereafter, the flow of water that has passed through the outer periphery of the boss and has reached the flat surface of the deflector passes through the slits provided in the outer periphery of the deflector at equal intervals, and the flow of water scatters toward a floor surface. Alternatively, the flow of water reaches the outer periphery of the deflector and scatters toward a wall surface.

At this time, the direction of the line that perpendicularly intersects with the plane passing through the pair of arms and that passes through the center axis of the nozzle is the position at which the flow of water is least influenced by the arms. There is no obstacle that prevents the flow of water, and the flow is smooth. As a result, the momentum of the water increases, and the water is spread farther away, so that the amount of water spray exceeding the prescribed wall wetting height can be obtained for the wall surface. However, at the same time, the amount of water spray in a short distance range immediately below the sprinkler head tends to be insufficient. To address this disadvantage, by making the length of the slit at this position greater than the length of the other slits to guide the flow of water onto the floor surface, the amount of water spray in the short distance range can be increased. In this manner, the water can be uniformly sprayed onto the floor surface. In addition, a desired wetting height can be obtained for the wall surface.

Advantageous Effects of Invention

As described above, according to the present invention, a desired water spray pattern can be obtained with a simplified deflector shape by reducing the occurrence of turbulence by using the tip of an impress screw and a boss. Furthermore, according to the sprinkler head having the above configuration, a sprinkler head can be achieved that is capable of clearing the water spray test and the fire extinguishing test defined by UL 1626 with the smallest flow rate.

DESCRIPTION OF EMBODIMENTS

Figure 1:
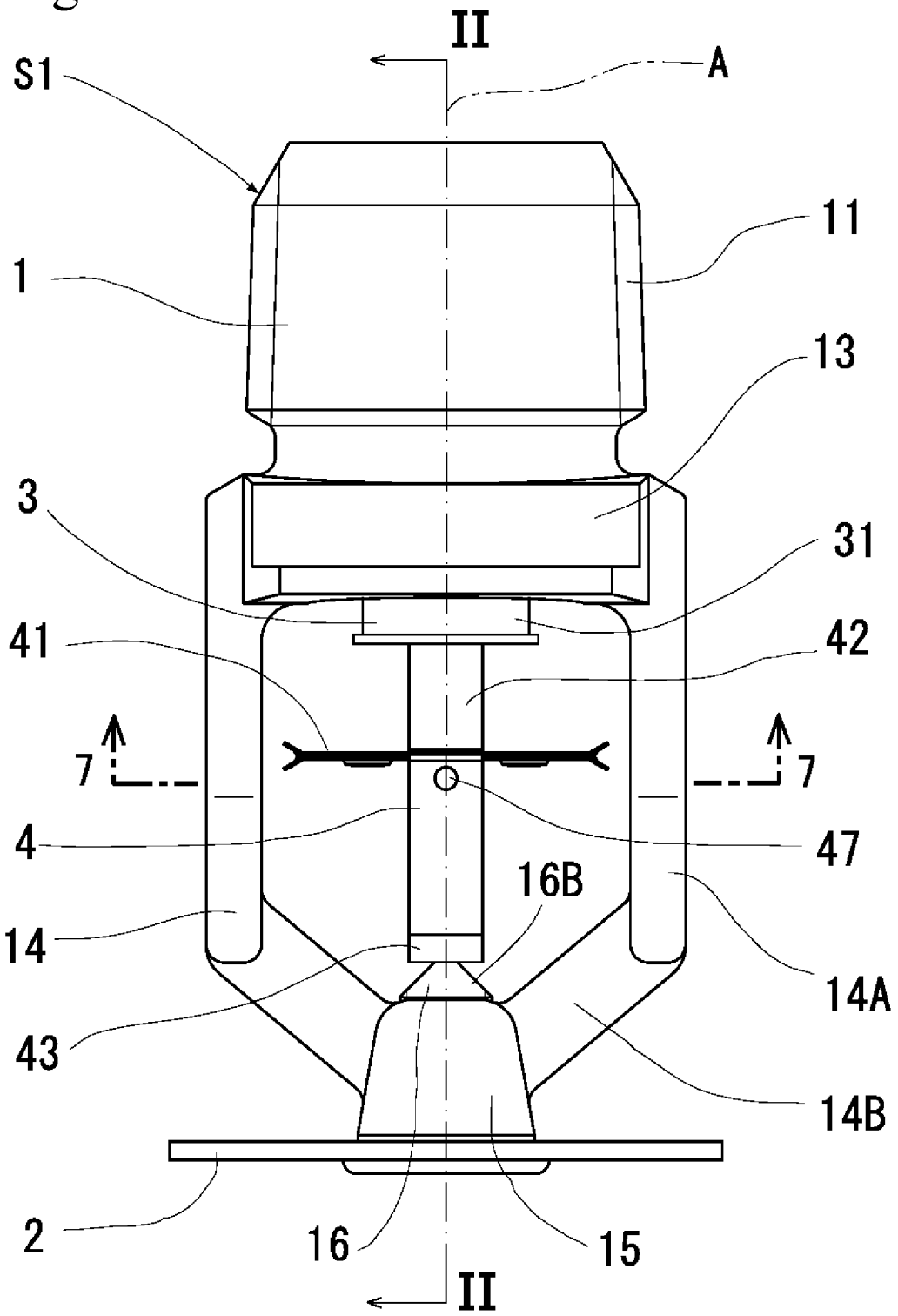
FIG. 1 is an external view of a sprinkler head according to the present invention.
Figure 2:
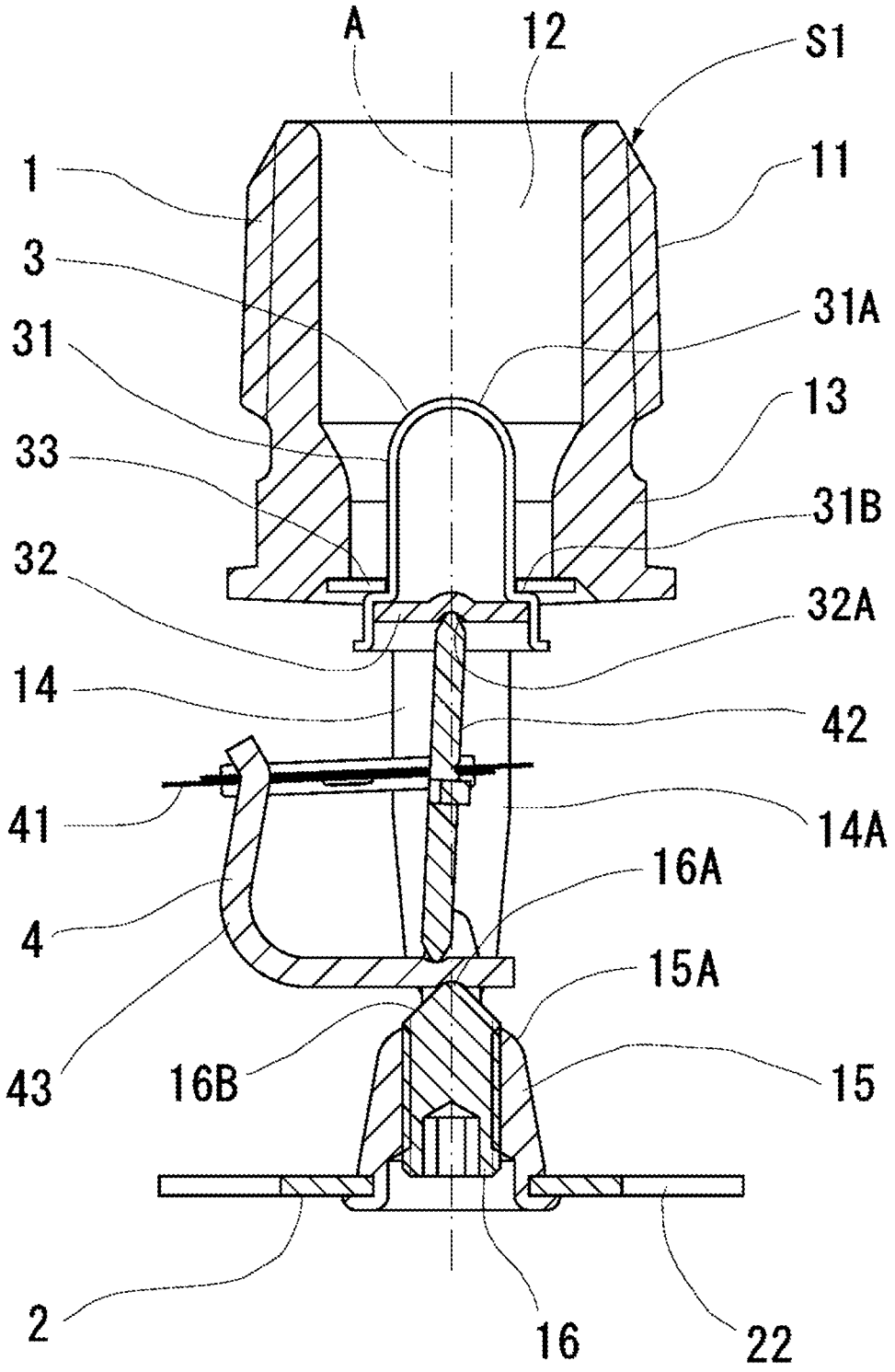
FIG. 2 is a cross-sectional view taken along a line II-II of FIG. 1.

As illustrated in FIGS. 1 and 2, a sprinkler head S1 according to the present invention includes a main body 1, a deflector 2, a valve 3, and a thermal decomposition unit 4.

The main body 1 has a hollow shape. The main body 1 is provided with a male screw 11 on the outer side to connect to a pipe in the ceiling and is provided with a nozzle 12 on the inner side. In terms of the size of the nozzle 12, a K factor derived from the flow rate and the water discharge pressure of the nozzle 12 is in the range of 3 to 5.8. According to the present embodiment, the value of the K factor is 4.9. The size of the male screw 11 connected to the pipe is NPT1/2 or R1/2.

Figure 3:
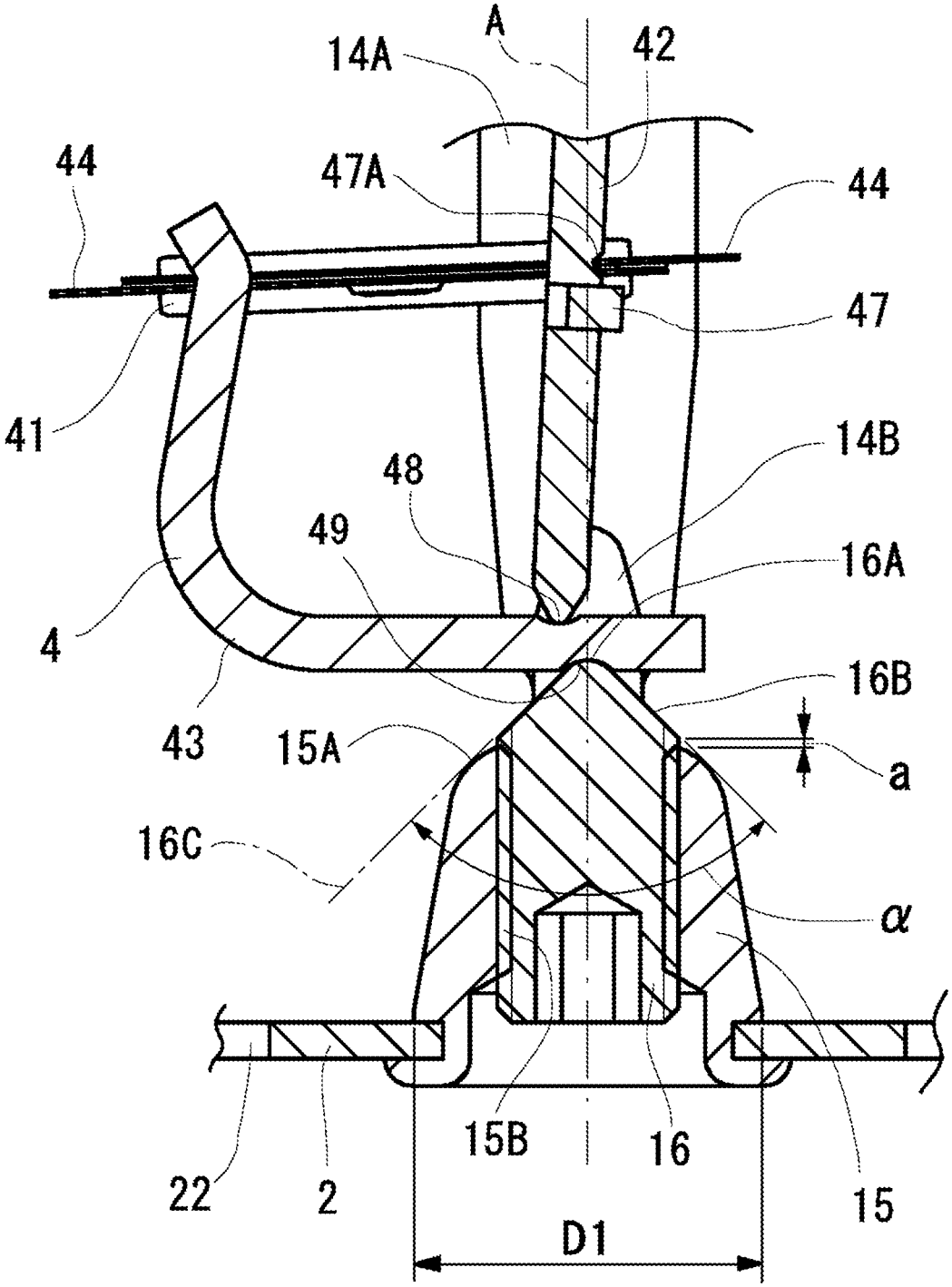
FIG. 3 is an enlarged view around a boss illustrated in FIG. 2.

In the vicinity of the outlet of the nozzle 12, a substantially rectangular base 13 is mounted, and a pair of arms 14 extending from the base 13 in the water discharge direction of the nozzle 12 is mounted. The arm 14 has a straight portion 14A extending substantially in parallel to a central axis A of the nozzle and an intersecting portion 14B connected from the end of the straight portion 14A to a boss 15 disposed on the central axis A of the nozzle 12. As illustrated in FIG. 3, the intersecting portion 14B is thinner than the straight portion 14A, and the cross-sectional shape is elliptical.

The boss 15 has a tapered cylindrical shape, and the deflector 2 is mounted at the front end of the boss 15. A diameter D1 of the boss 15 at the end in contact with the deflector 2 is 9 mm to 10 mm. The outer diameter of the end of the boss 15 adjacent to the nozzle 12 is smaller than the diameter D1 at the end adjacent to the deflector 2. The outer peripheral end 15A of the boss 15 adjacent to the nozzle 12 has a shape of a rounded surface, and the radius of the rounded surface is in the range of 1 mm to 3 mm. According to the present embodiment, the radius of the rounded surface is 2 mm.

A female screw 15B is provided inside the boss 15, and an impress screw 16 is screwed into the female screw 15B. A tip 16A of the impress screw 16 is sharply pointed and has a slope surface 16B. The tip 16A faces the nozzle 12, and an angle $\alpha$ of the slope surface 16B is in the range of 80° to 100°. According to the present exemplary embodiment, the angle $\alpha$ is 90°. The apex of the tip 16A is spherical. It is desirable that the radius of the spherical surface be 2 mm or less. According to the present embodiment, the radius of the spherical surface is 1 mm or less.

The impress screw 16 has a function of urging the valve 3 toward the nozzle 12 via the thermal decomposition unit 4. In FIG. 3, an extension line 16C extending along the slope surface 16B of the tip 16A of the impress screw 16 is in close vicinity of or in contact with the rounded surface of an outer peripheral end 15A of the boss 15. Accordingly, when water flowing along the surface of the tip 16A passes through the outer peripheral end 15A, the outer peripheral end 15A does not interfere with the flow of water, which prevents the occurrence of turbulence flow. At this time, a gap "a" between the slope surface 16B of the impress screw 16 and the end surface of the boss 15 adjacent to the nozzle 12 is set to 2 mm or less, and more preferably is set to 1 mm or less. If the gap is greater than this value, a turbulence flow is likely to occur.

Figure 4:
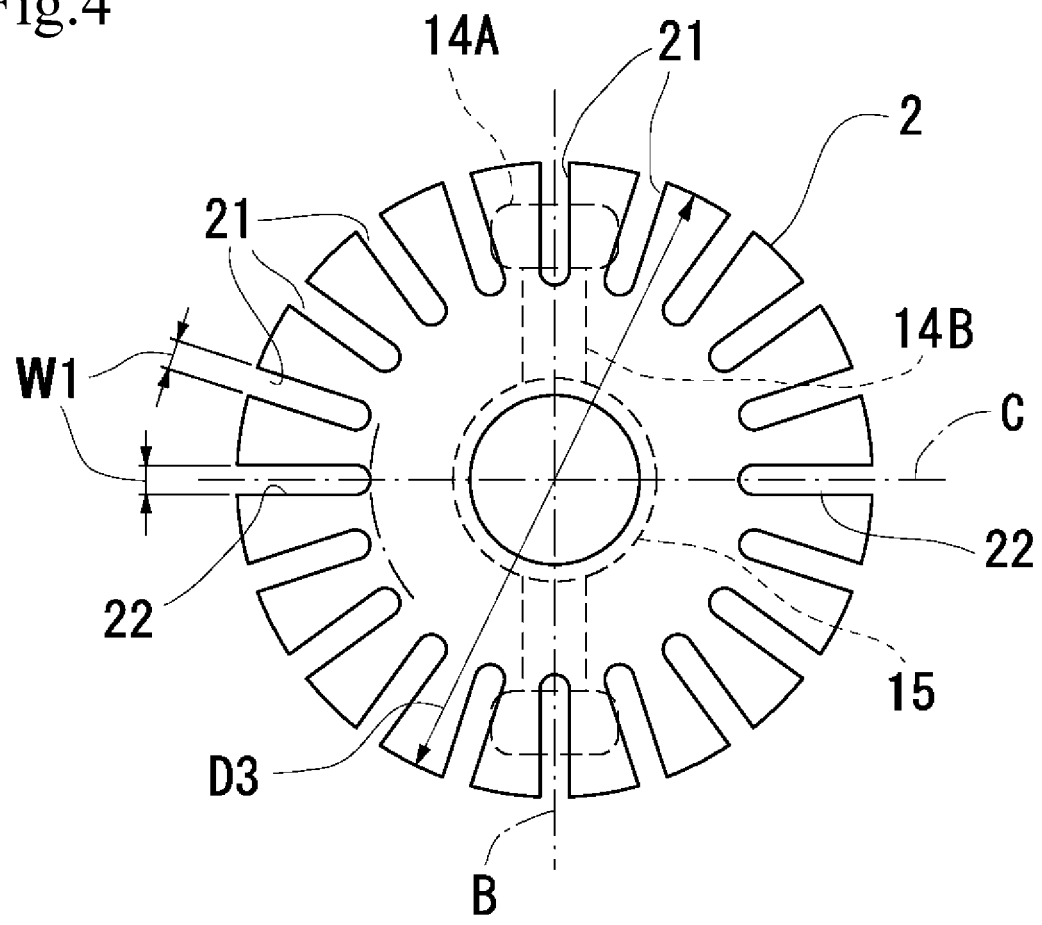
FIG. 4 is a plan view of a deflector.

The deflector 2 illustrated in FIG. 4 has a disc shape, and its outer diameter D3 is in the range of 28 mm to 32 mm. According to the present embodiment, the outer diameter D3 is 30 mm. A plurality of slits 21 are provided on the peripheral edge of the deflector 2. Each of the slits 21 is formed on a straight line that extends from the peripheral edge of the deflector 2 and passes through the center point of the deflector 2. In FIG. 4, the arms 14 indicated by a short dashed line are disposed on a straight line B. The straight line B represents a plane passing through the pair of arms 14, and slits 22 (first slits) are provided on a line C that perpendicularly intersects with the straight line B and passes through the central axis A.

The slit 22 is longer than the slit 21, and the length of the slit 21 is in the range of 4.5 mm to 7 mm. According to the present embodiment, the length of the slit 21 is 5.8 mm. The length of the slit 22 is in the range of 5.5 mm to 8 mm. According to the present embodiment, the length of the slit 22 is 6.3 mm.

The distance between each of the slits 21 and 22 and the neighboring slit thereof is the same on the outer periphery of the deflector 2. The total number of the slits (the slits 21 and the slits 22) is in the range of 16 to 24. According to the present embodiment, the total number of the slits is 20. Widths W1 of the slits 21 and 22 are all the same and are set in the range of 1 mm to 2 mm. According to the present embodiment, the widths W1 are all 1.4 mm. The deflector 2 is symmetrical with respect to the line B. In addition, the deflector 2 is symmetrical with respect to the line C.

Figure 5:
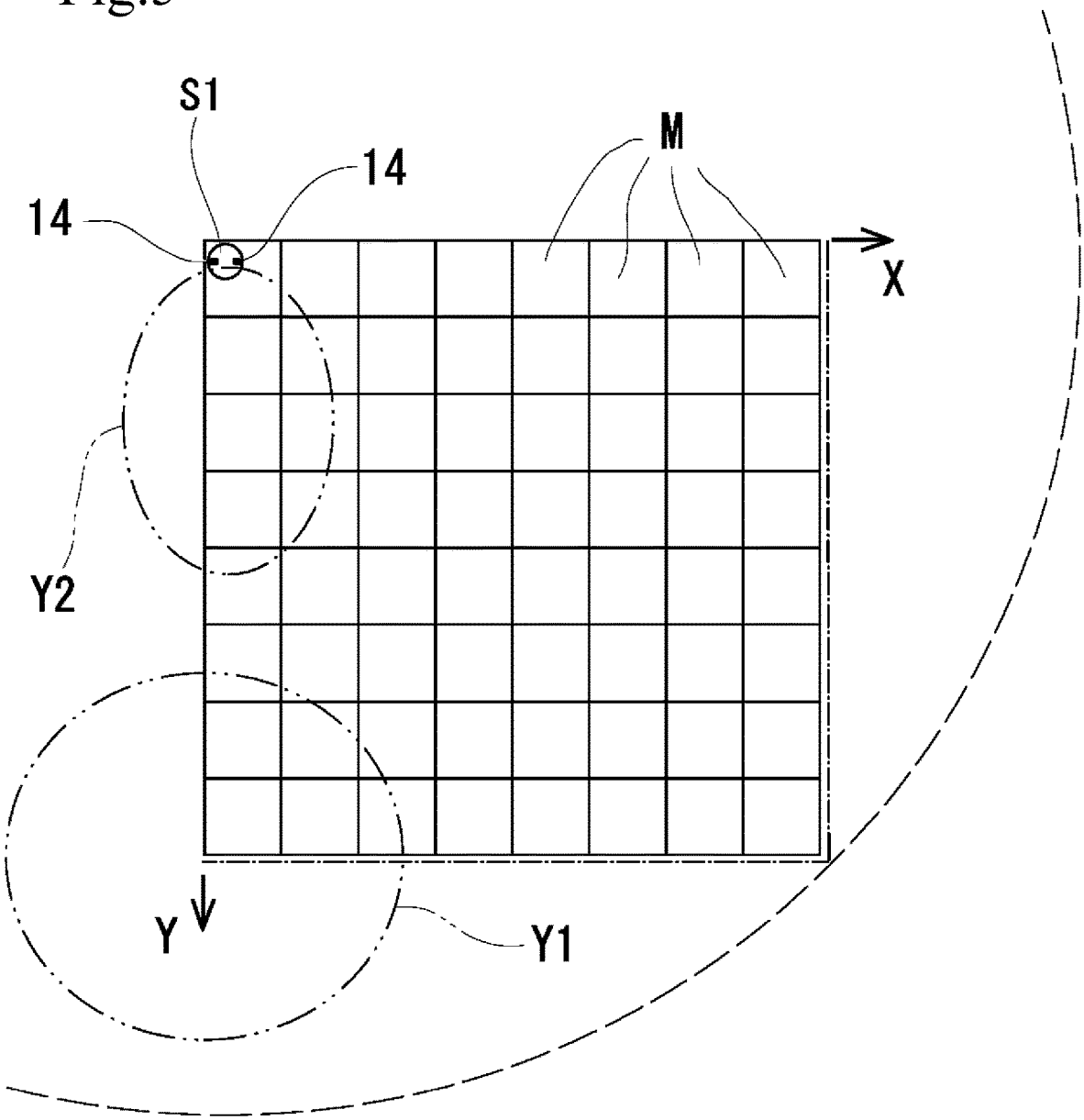
FIG. 5 is a diagram illustrating a positional relationship between a sprinkler head and a water spray test facility.

In the positional relationship between the sprinkler head S1 and a water spray test facility illustrated in FIG. 5, the sprinkler head S1 is installed on a ceiling in a corner cell of a plurality of water sampling cells M, which are arranged vertically and horizontally without any gap. In the drawing, the arm 14 is disposed in the direction of an arrow X, and the slits 22 are disposed in the direction of an arrow Y. According to UL 1626, it is necessary to ensure a predetermined amount of water or more for each of the cells M. In this test facility, the amount of water spray can be measured for ¼ of the protection area of the sprinkler head S1. The water spray pattern has a substantially circular shape due to the shape of the deflector 2. Ideally, it is desirable that water be uniformly sprayed onto all the water sampling cells within a quarter circle indicated by a short dashed line in FIG. 5.

However, the arms 14 interfere with the flow of the water discharged from the nozzle 12 and, thus, the flight distance of the water in the direction of the arrow X is shorter than that in the direction of the arrow Y. Conversely, in the direction of the arrow Y, the amount of water sprayed onto a region Y1 distant from the sprinkler head S1 tends to be large, and the amount of water sprayed onto a region Y2 in front of the sprinkler head S1 tends to be small. However, by adjusting the length of the slit 22, the amount of water sprayed onto the region Y1 can be decreased, and the amount of water sprayed onto region Y2 can be increased. Thus, the water is sprayed substantially uniformly over all of the water spraying cells. In this manner, the amount of water sprayed onto each of the regions Y1 and Y2 can be freely controlled.

At this time, if the length of the slit 22 is more than 1 time but less than or equal to 1.5 times the length of the slit 21, the distribution of water spray on the floor surface becomes uniform. If the length of the slit 22 exceeds 1.5 times the length of the slit 21, the amount of water sprayed onto the region Y2, which is located substantially immediately below the sprinkler head S1, tends to increase excessively.

Figure 6:
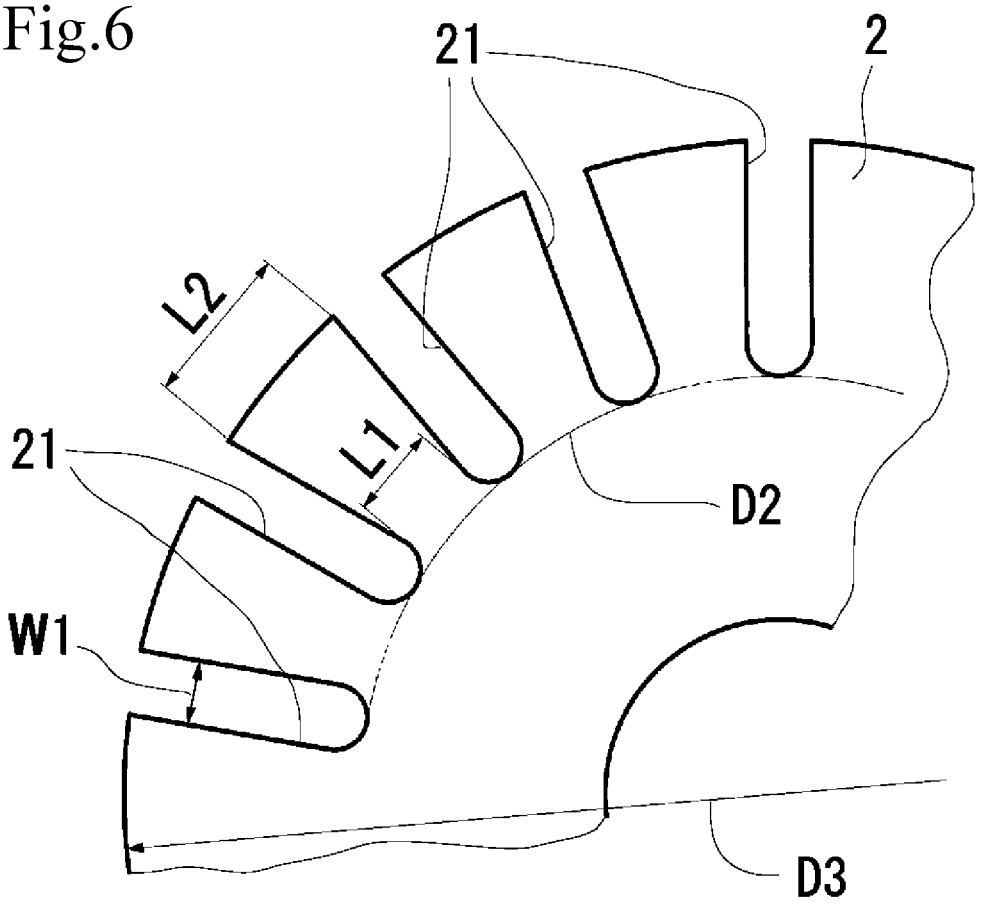
FIG. 6 is an enlarged view of a slit portion illustrated in FIG. 4.

FIG. 6 is an enlarged view of the slits 21. The minimum distance between two neighboring slits 21 is denoted by L1, and the maximum distance is denoted by L2. Furthermore, FIG. 6 illustrates an inscribed circle D2 which the end of each of the slits 21 adjacent to the boss 15 is in contact with. At this time, the ratio of between the minimum slit distance L1 and the maximum slit distance L2 (L1/L2) and the ratio between the minimum distance between the slits 21 and the width W1 of the slit 21 (L1/W1) have an influence on the water spray density of the floor surface. It is desirable that the value of L1/L2 be within the range of 1.8 to 2 and the numerical value of L1/W1 be within the range of 1.15 to 1.3 in accordance with the shape of the slit 21.

For the sprinkler head S1 illustrated in FIG. 5, to measure the height of a wall surface wetted by spraying water (the distance from the ceiling surface to the wet location on the wall surface; hereinafter referred to as a "wall wetting height"), wall surfaces are provided corresponding to the locations denoted by alternate long and short dash lines. The inscribed circle D2 which the end of each of the slits 21 adjacent to the boss 15 is in contact with has an influence on the wall wetting height. If the diameter of the inscribed circle D2 is set to 18 mm to 19.5 mm, the wall wetting height is in the range of 20 inches to 35 inches.

In the above description, there is a trade-off relationship between the amount of water sprayed onto the floor surface (the water spray density) and the wall wetting height. Accordingly, to satisfy both the amount of water sprayed onto the floor surface and the wall wetting height, it is desirable that the slit 21 be configured such that the above-described ratio between the minimum slit distance L1 and the maximum slit distance L2 (L1/L2), the ratio between the minimum distance between the slits 21 and the width W1 of the slit 21 (L1/W1), and the diameter of the inscribed circle D2 are within the above-described ranges.

Figure 7:
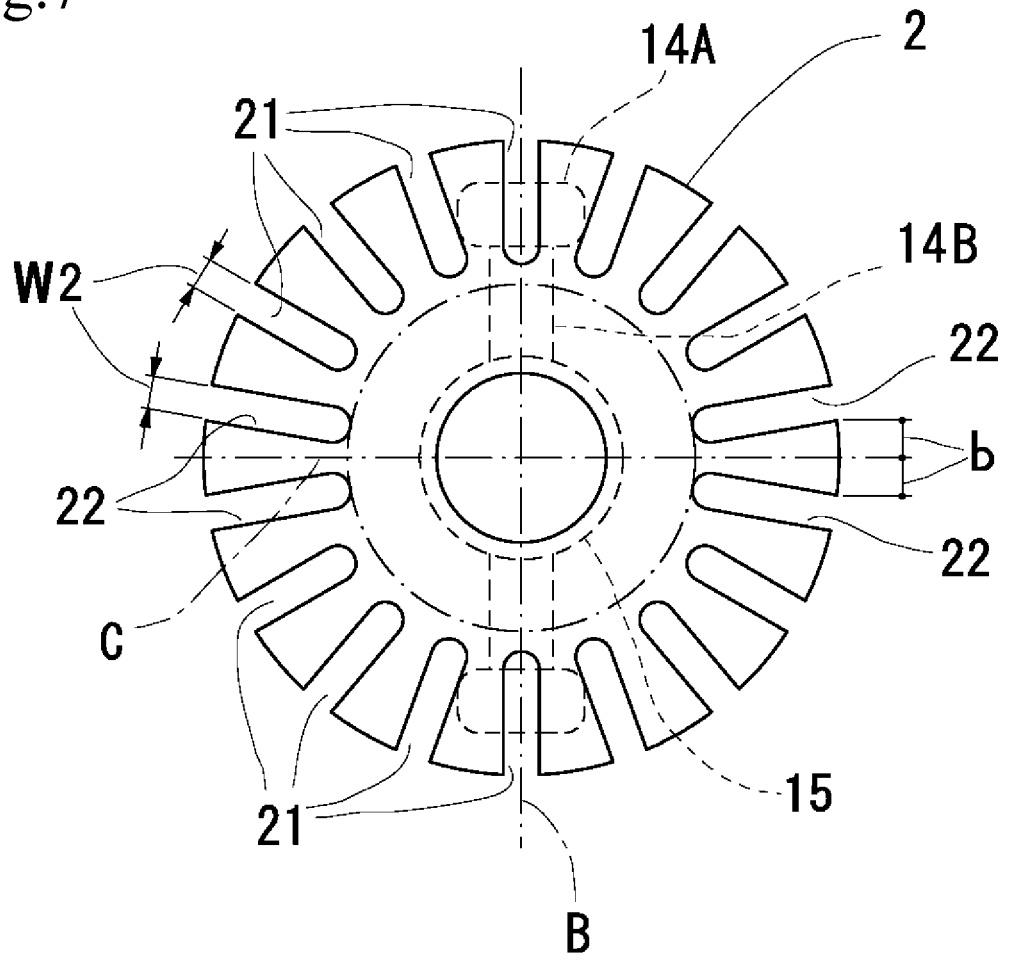
FIG. 7 illustrates an example of a modification of the deflector illustrated in FIG. 4.
Figure 8:
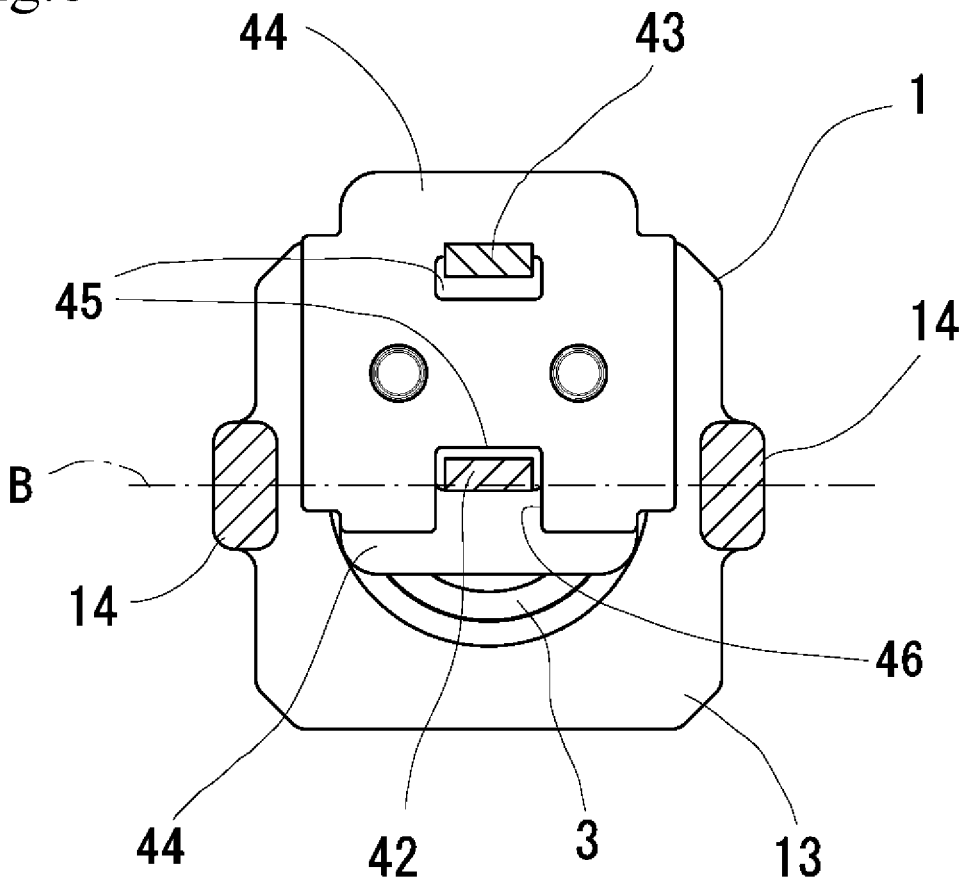
FIG. 8 is a cross-sectional view taken along a line 7-7 of FIG. 1.

FIG. 7 illustrates a modification of the deflector 2 in which slits 22 each adjacent to a line C are provided. In FIG. 7, four slits 22 are provided, and the total number of slits including the slits 21 and the slits 22 is 18. Widths W2 of the slits 21 and 22 are all the same and are set in the range of 1 mm to 2 mm. According to the present embodiment, the width W2 is 1.7 mm. The distance b between the line C and each of the two slits 22 and 22 adjacent to the line C is the same.

The valve 3 closes the outlet of the nozzle 12 at normal times. The valve 3 includes a valve cap 31, a disk 32, and a disc spring 33. The valve cap 31 has a cylindrical shape and has a spherical bottom 31A at one end. The other end is enlarged in diameter and has a step 31B formed therein.

The disk 32 is placed on the inner peripheral side of the step 31B. The disk 32 has a recess 32A at the center thereof, and the recess 32A is engaged with one end of a columnar support 42 of a thermal decomposition unit 4.

A disc spring 33 is locked on the outer peripheral side of the step 31B. The disc spring 33 is inserted from the bottom 31A of the valve cap 31. The surface of the disc spring 33 is covered with a fluorine resin. The outer peripheral edge of the disc spring 33 is disposed at the end of outlet of the nozzle 12. When the impress screw 16 is screwed into the female screw 15B of the boss 15, the disc spring 33 is pressed via the thermal decomposition unit 4 and is crushed due to its elastic deformation. At this time, the fluorine resin functions as a sealing material so as to seal the nozzle 12.

The thermal decomposition unit 4 includes a link 41, the columnar support 42, and a lever 43. The link 41 is a heat-sensitive element that operates in response to the heat of a fire. The link 41 is formed by bonding two thin metal plates 44 into one with a low melting point alloy. The low melting point alloy has a melting point in the range of 60° C. to 200° C. In general, a low melting point alloy having a melting point of 72° C. or 96° C. is used.

Each of the two substantially rectangular metal plates 44 has a hole 45 at one end and a U-shaped notch 46 at the other end. The two metal plates 44 are bonded with a low melting point alloy such that the ends having the notches 46 are overlapped with each other. At this time, the notch 46 of one of the metal plates 44 is overlapped over the position of the hole 45 of the other metal plate 44. After the metal plates 44 are bonded, the columnar support 42 is inserted into one of the holes 45 of the link 41, and the lever 43 is inserted into the other hole 45.

The columnar support 42 has a strip shape. One end of the columnar support 42 is engaged with the disk 32 of the valve 3 mounted at the outlet of the nozzle 12, and the other end is engaged with the tip of the lever 43. As described above, the hole 45 of the link 41 has the columnar support 42 inserted thereinto. A protrusion 47 is provided in the middle of the columnar support 42, and the link 41 is locked in a groove 47A provided in the vicinity of the protrusion 47.

The lever 43 is formed by bending an elongated plate into a substantially L-shape. As described above, one end of the lever 43 is inserted into the hole 45 of the link 41. The other end of the lever 43 is engaged with the columnar support 42, and the lever 43 is provided with a groove 48 with which the tip of the columnar support 42 is engaged.

A concave portion 49 is provided on a surface on the back side of the surface having the groove 48 provided thereon. The concave portion 49 is provided at a position closer to the other end of the lever 43 than the groove 48. The impress screw 16 is in contact with the concave portion 49. If the tip of the impress screw 16 presses the concave portion 49 of the lever 43, a rotating force around the groove 48 serving as a fulcrum and having the columnar support 42 locked therein acts on the lever 43. However, the hole 45 of the link 41 has one end of the lever 43 inserted thereinto and, thus, the rotation of the lever 43 is prevented. As a result, the link 41, the columnar support 42, and the lever 43 that constitute the thermal decomposition unit 4 maintain the engaged state. In addition, the impress screw 16 keeps pressing the valve 3 toward the nozzle 12 via the thermal decomposition unit 4.

If a fire occurs and the low melting point alloy of the link 41 melts, one of the metal plates 44 is peeled off from the other metal plate 44 by the above-described rotation of the lever 43. As a result, the engaged state of the thermal decomposition unit 4 is released and, thus, the link 41, the columnar support 42, and the lever 43 are disengaged. In addition, the valve 3 supported by the columnar support 42 is separated from the nozzle 12 and drops off, and the nozzle 12 is opened.

The embodiment of the present invention has been described above. Structures and operations other than those of the embodiment are described below.

While the above embodiment has been described with reference to the concave portion 49 as the shape of the portion of the lever 43 that engages with the impress screw 16, the present invention is not limited thereto. For example, the shape may be a protruding shape. In this case, the shape of the tip of the impress screw 16 can be changed to a concave portion or a groove that matches the protruding shape.

In addition, the present invention is also applicable to a sprinkler head using a glass bulb for the thermal decomposition unit 4. In this case, the shape of the tip of the impress screw 16 may be a concave shape so as to receive the glass bulb.

The ratio of (the diameter D1 of the boss):(the inscribed circle D2 that the end of each of the slits 21 adjacent to the boss 15 is in contact with):(the outer diameter D3 of the deflector) is approximately set so that D1:D2:D3=1:2:3. In this way, both the amount of water sprayed on the floor surface and the wall wetting height can be made satisfactory.

REFERENCE SIGNS LIST

S1 sprinkler head
1 main body
2 deflector
3 valve
4 thermal decomposition unit
12 nozzle
14 arm
15 boss
15A outer peripheral end of boss
16 impress screw
16B slope surface
21 slit
22 slit (first slit)
31 valve cap
32 disk
33 disc spring
41 link
42 columnar support
43 lever

The invention claimed is:

1. A sprinkler head comprising:
a main body;
a pair of arms;
an impress screw; and
a deflector having a disc shape, wherein
the main body includes a nozzle connected to a water supply pipe,
the pair of arms extends from the main body in a water discharge direction of the nozzle,
a tip of each of the arms is connected to a boss that has a columnar shape and that is disposed on a central axis of the nozzle,
the impress screw is screwed into a female screw included in the boss, and a tip of the impress screw protrudes from the boss toward the nozzle,
the deflector is mounted at a front end of the boss and has a plurality of slits cut around a peripheral edge of the deflector, from an outer periphery of the deflector toward the central axis of the nozzle,
the plurality of slits includes first slits and second slits,
a length of the first slits is greater than a length of the second slits,
the first slits are provided at a position closest, among the plurality of slits, to a first line on the deflector(2),
the first line passes through the central axis of the nozzle, and perpendicularly intersects with a second line,
the second line is on the deflector, passes through the central axis, and is parallel to a plane,
the plane bisects the pair of arms and passes through the central axis, and
wherein the plane passes through an intersecting portion of the arms connected to the boss.

2. The sprinkler head according to claim 1, wherein the first slits are disposed on the first line.

3. The sprinkler head according to claim 1, wherein the length of the second slits is 4.5 mm to 7 mm, and the length of the first slit is more than 1 time and less than or equal to 1.5 times to the length of the second slits.

4. The sprinkler head according to claim 1, wherein a total number of the second slits and the first slits is 16 to 24.

5. The sprinkler head according to claim 1, wherein widths of the first slits and widths of the second slits are all the same.

6. The sprinkler head according to claim 1, wherein an outer peripheral end of the boss facing the nozzle has a shape of a rounded surface, and a slope surface of the tip of the impress screw is in contact with an end surface of the rounded surface of the outer peripheral end.

7. The sprinkler head according to claim 6, wherein an angle between a first slope and a second slope in a cross-sectional view of the tip of the impress screw is 80° to 100°.

8. The sprinkler head according to claim 7, wherein an apex of the tip of the impress screw has a rounded surface-whose radius is less than or equal to 2 mm.

9. The sprinkler head according to claim 6, wherein a radius of the rounded surface of the outer peripheral end of the boss facing to the nozzle is 1 mm to 3 mm.

10. The sprinkler head according to claim 1, wherein two of the second slits directly adjacent to each other have a smallest distance of separation and a largest distance of separation so that a ratio of the smallest distance and the largest distance of separation is 1.8 to 2.

11. The sprinkler head according to claim 1, wherein a ratio between a smallest distance between two of the second slits and a width of the second slits is 1.15 to 1.3.

12. The sprinkler head according to claim 1, wherein an end of each of the second slits on a boss side is in contact with an inscribed circle having a diameter of 18 mm to 19.5 mm.

13. The sprinkler head according to claim 1, wherein a K factor derived from a flow rate and a water discharge pressure of the nozzle is 3 to 5.8.

14. The sprinkler head according to claim 1, wherein a ratio of a diameter D1 of the boss: an inscribed circle D2 contacting with an end of the second slits on a boss side: an outer diameter D3 of the deflector is set so that D1:D2:D3=1:2:3.

15. The sprinkler head according to claim 1, wherein_the first line is located between the first slits which are located next to each other.

16. The sprinkler head according to claim 1, wherein an outer peripheral end of the boss facing the nozzle has a rounded surface, and a gap is formed between a sloped surface of the tip and an end surface of the rounded surface of the outer peripheral end, the gap is 2 mm or less.

17. The sprinkler head according to claim 16, wherein the gap is 1 mm or less.

18. The sprinkler head according to claim 1, wherein one end, closest to the central axis, of the first slits is located closer to the central axis than one end, closest to the central axis of the second slits.

19. The sprinkler head according to claim 1, wherein a distance between each of the plurality of the slits is the same on the outer periphery of the deflector.

* * * * *